US009489901B2

(12) United States Patent
Nakai et al.

(10) Patent No.: US 9,489,901 B2
(45) Date of Patent: Nov. 8, 2016

(54) DISPLAY DEVICE

(71) Applicant: Panasonic Liquid Crystal Display Co., Ltd., Himeji-shi, Hyogo (JP)

(72) Inventors: Takashi Nakai, Hyogo (JP); Ryutaro Oke, Hyogo (JP); Toshiki Onishi, Hyogo (JP); Junichi Maruyama, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 59 days.

(21) Appl. No.: 14/591,677

(22) Filed: Jan. 7, 2015

(65) Prior Publication Data

US 2015/0109357 A1 Apr. 23, 2015

Related U.S. Application Data

(63) Continuation of application No. PCT/JP2013/003999, filed on Jun. 26, 2013.

(30) Foreign Application Priority Data

Aug. 30, 2012 (JP) ..... 2012-190584

(51) Int. Cl.

| | |
|---|---|
| ***G09G 5/10*** | (2006.01) |
| ***G09G 3/38*** | (2006.01) |
| ***G09G 3/36*** | (2006.01) |

(52) U.S. Cl.

CPC ..... *G09G 3/36* (2013.01); *G09G 3/3666* (2013.01); *G09G 3/3685* (2013.01); *G09G 3/3674* (2013.01); *G09G 3/3688* (2013.01);

(Continued)

(58) Field of Classification Search

CPC .... G09G 3/36; G09G 3/3674; G09G 3/3685; G09G 2300/0478; G09G 2310/0251; G09G 2310/0283; G09G 3/3688; G09G 2310/08; G09G 2310/021; G09G 2310/0232; G09G 3/3666

See application file for complete search history.

(56) References Cited

U.S. PATENT DOCUMENTS

2003/0218594 A1* 11/2003 Ishii ..... G09G 3/3688 345/96
2007/0152947 A1* 7/2007 Tanaka ..... G09G 3/3688 345/100

(Continued)

FOREIGN PATENT DOCUMENTS

JP 4-120591 4/1992
JP 10-268261 10/1998

(Continued)

*Primary Examiner* — Charles Hicks
(74) *Attorney, Agent, or Firm* — Hamre, Schumann, Mueller & Larson, P.C.

(57) ABSTRACT

A display device includes a divided display region that includes pixels and gate drivers each configured to scan gate lines included in the divided display region. The display device also includes source drivers each configured to output, for each of groups of data lines, a video signal based on a grayscale signal in order from a corresponding gate driver side based on each delay amount set in advance and a register unit configured to store the each delay amount. The register unit stores the each delay amount so that, when at least one gate driver scans in a first order from an edge of the divided display region toward a center, the video signal corresponding to the pixels positioned on a centermost side of the display region is output to the pixels, in a period including a part of a vertical flyback period of after one frame period has finished.

5 Claims, 7 Drawing Sheets

(52) U.S. Cl.
CPC *G09G2300/0478* (2013.01); *G09G 2310/021* (2013.01); *G09G 2310/0232* (2013.01); *G09G 2310/0251* (2013.01); *G09G 2310/0283* (2013.01); *G09G 2310/08* (2013.01)

(56) References Cited

U.S. PATENT DOCUMENTS

| | | | |
|---|---|---|---|
| 2008/0136810 | A1 | 6/2008 | Itakura et al. |
| 2009/0009498 | A1 | 1/2009 | Nishimura |
| 2011/0007065 | A1 | 1/2011 | Tanaka et al. |
| 2012/0050146 | A1 | 3/2012 | Tanaka et al. |
| 2013/0120353 | A1 | 5/2013 | Tanaka et al. |
| 2013/0222350 | A1 | 8/2013 | Tanaka et al. |

FOREIGN PATENT DOCUMENTS

| | | |
|---|---|---|
| JP | 2005-070298 | 3/2005 |
| JP | 2007-171597 | 7/2007 |
| JP | 2009-015178 | 1/2009 |
| JP | 2011-232780 | 11/2011 |

* cited by examiner

DISPLAY DEVICE

CROSS-REFERENCE TO RELATED APPLICATION

The present application is a Bypass Continuation of International Application No. PCT/JP2013/003999, filed on Jun. 26, 2013, which claims priority from Japanese Patent application JP2012-190584 filed on Aug. 30, 2012. The contents of these applications are hereby incorporated into the present application by reference in their respective entireties.

TECHNICAL FIELD

The present invention relates to a display device.

BACKGROUND

For the recent increasing of the definition of liquid crystal display devices, the write time for writing a display signal to a pixel electrode may not be sufficient, which may lead to deterioration in the quality of the display image. To increase the write time per pixel, a so-called divisional drive technology is known. In this technology, the screen is divided into two, an upper half and a lower half, and the upper half and the lower half of the screen are separately driven (refer to Japanese Patent Application Laid-open No. Hei 10-268261).

Further, in a liquid crystal display device, the waveform of a scanning signal input to a gate line is not as sharp further away from the input terminal. In view of this, a so-called delay technology is known that slows the output timing of the video signal to a distant video signal line from the input terminal of the gate line (refer to Japanese Patent Application Laid-open No. 2007-171597).

In addition, in a liquid crystal display device, it takes time to increase the drive voltage of the pixels. Therefore, a so-called pre-charge technology is known in which a predetermined voltage (pre-charge data) is applied before applying a voltage based on the actual grayscale voltage (refer to Japanese Patent Application Laid-open No. 2009-15178).

SUMMARY

When the above-mentioned divisional drive is employed, at the upper half or lower half display region, gate scanning may be performed in the direction from the edge of the display region toward the center, or in the direction from the center of the display region toward the edge. Further, even when such divisional drive is employed, the above-mentioned delay technology and pre-charge technology may be employed.

Here, when gate scanning is performed, the timing of the output of the gate signal may be out of step with the timing of the output of the corresponding video signal. In such a case, for example, when the 500-th line is scanned, the video signal and the like corresponding to the 501-st line may be output. However, the period after the final line (e.g., the 1,080-th line) of the display region has been scanned is a flyback period during which the video signal is not output. Therefore, especially for a so-called solid display (e.g., a uniform white display), there is a problem in that the luminance of the final line is less than the luminance of the other lines. In the case in which driving is performed without dividing the display region, this problem is not as noticeable because luminance at the lines of the bottommost portion or the topmost portion of the screen is decreased. However, when scanning is performed from the edge of the display region toward the center, luminance at the center of the screen is decreased, causing image quality to deteriorate. This is especially noticeable for the above-mentioned solid display.

In general, in the case in which driving is performed without dividing the display region, a setting value optimized for the center of the screen is used for the above-mentioned pre-charge data. Further, for the pre-charge data, data that is based on an output signal output to the pixels of the previous line is used. Therefore, when gate scanning is performed in the direction from the center of the display region toward the edge, the first line in the case of divisional drive is positioned in the center of the panel. Consequently, because there is no output signal of the previous line for the first line, the pre-charge effects may be more noticeable than for the pixels on other lines. This is especially noticeable for a solid display.

In view of the above-mentioned problems, one object of one or more embodiments of the present invention is to improve image quality at a boundary between an upper half display region and a lower half display region when driving is performed by dividing a panel.

(1) In one or more embodiments of the present invention, a display device includes a divided display region that includes a plurality of pixels that are subdivided into a matrix shape by a plurality of gate lines and a plurality of data lines and a plurality of gate drivers each configured to scan in order the plurality of gate lines included in the divided display region. The display device also includes a plurality of source drivers each configured to output, for each of groups of the plurality of data lines, a video signal based on a grayscale signal in order from a corresponding gate driver side based on each delay amount set in advance and a register unit configured to store the each delay amount. The register unit stores the each delay amount set so that, when at least one gate driver among the plurality of gate drivers scans in a first order from an edge of the divided display region toward a center, the video signal corresponding to the plurality of pixels positioned on a centermost side of the display region among the plurality of gate lines scanned by the at least one gate driver is output to the plurality of pixels, in a period including a part of a vertical flyback period of after one frame period has finished.

(2) In the display device of (1), the each delay amount includes a delay amount larger than each delay amount set when the at least one gate driver scans in a second order from the center of the divided display region toward the edge.

(3) In the display device of (1), the each delay amount is larger than each delay amount set when scanning is carried out without dividing the display region.

(4) In the display device of (1), the display device further includes a pre-charge data generation unit configured to generate pre-charge data to be output to each of the plurality of pixels before an output signal corresponding to the grayscale signal is output to the plurality of corresponding data lines. Each of the plurality of source drivers outputs to the plurality of data lines the video signal that is based on the pre-charge data and the grayscale signal.

(5) In the display device of (4), the pre-charge data to be set when the at least one gate driver scans in the first order is larger than the pre-charge data to be set when the at least one gate driver scans in a second order from the center of the divided display region toward the edge.

(6) In the display device of (5), the display device further includes an order changing unit configured to change a scanning order from the first order to the second order or from the second order to the first order for each divided display region.

(7) In one or more embodiments of present invention, a display device includes a divided display region that comprises a plurality of pixels that are subdivided into a matrix shape by a plurality of gate lines and a plurality of data lines. The display device also includes a plurality of gate drivers each configured to scan in order the plurality of gate lines included in the divided display region, a plurality of source drivers each configured to output, for each of groups of the plurality of data lines, a video signal based on a grayscale signal in order from a corresponding gate driver side based on each delay amount set in advance, and a pre-charge data generation unit configured to generate pre-charge data to be output to each of the plurality of pixels before the grayscale signal is output to the plurality of corresponding data lines. Each of the plurality of source drivers outputs to the plurality of data lines the video signal that is based on the pre-charge data. The pre-charge data to be set when at least one of the plurality of gate drivers scans in a first order from an edge of the divided display region toward a center is larger than the pre-charge data to be set when the at least one of the plurality of gate drivers scans in a second order from the center of the divided display region toward the edge.

(8) In the display device of (7), the pre-charge data is larger than pre-charge data to be set when scanning is carried out without dividing the display region.

DETAILED DESCRIPTION

Figure 1:
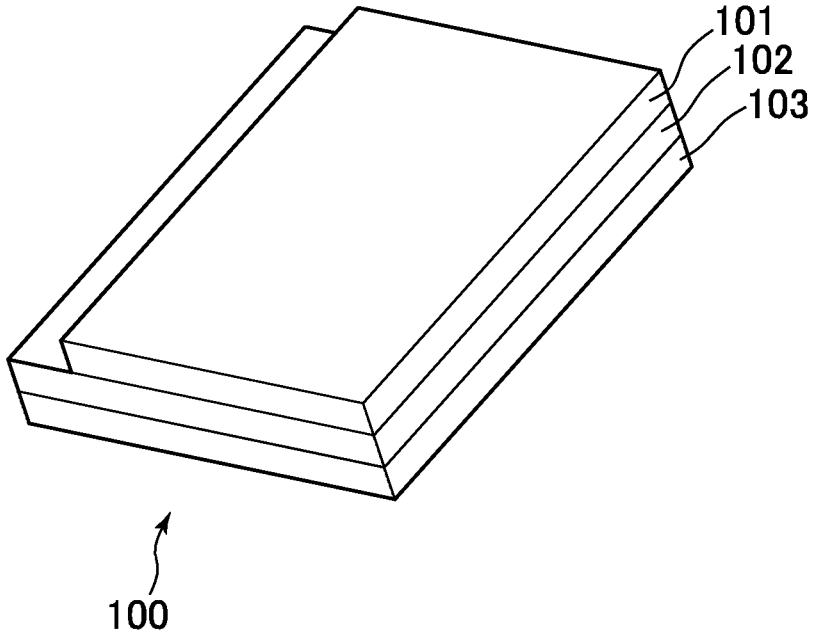
FIG. 1 is a schematic diagram illustrating a display device according to an embodiment of the present invention.

FIG. 1 is a schematic diagram illustrating a display device according to an embodiment of the present invention. As illustrated in FIG. 1, a display device 100 includes, for example, a thin film transistor (TFT) substrate 102 and a filter substrate 101. On the TFT substrate 102, TFTs and the like (not shown) are formed. The filter substrate 101 is opposed to the TFT substrate 102 and is provided with color filters (not shown). The display device 100 also includes a liquid crystal material (not shown) and a backlight unit 103. The liquid crystal material is sealed in a region sandwiched between the TFT substrate 102 and the filter substrate 101. The backlight unit 103 is provided on the TFT substrate 102 so as to be held in contact with a surface opposite to the side on which the filter substrate 101 is provided. Note that, an outline of the display device illustrated in FIG. 1 is merely an example, and this embodiment is not limited thereto.

Figure 2:
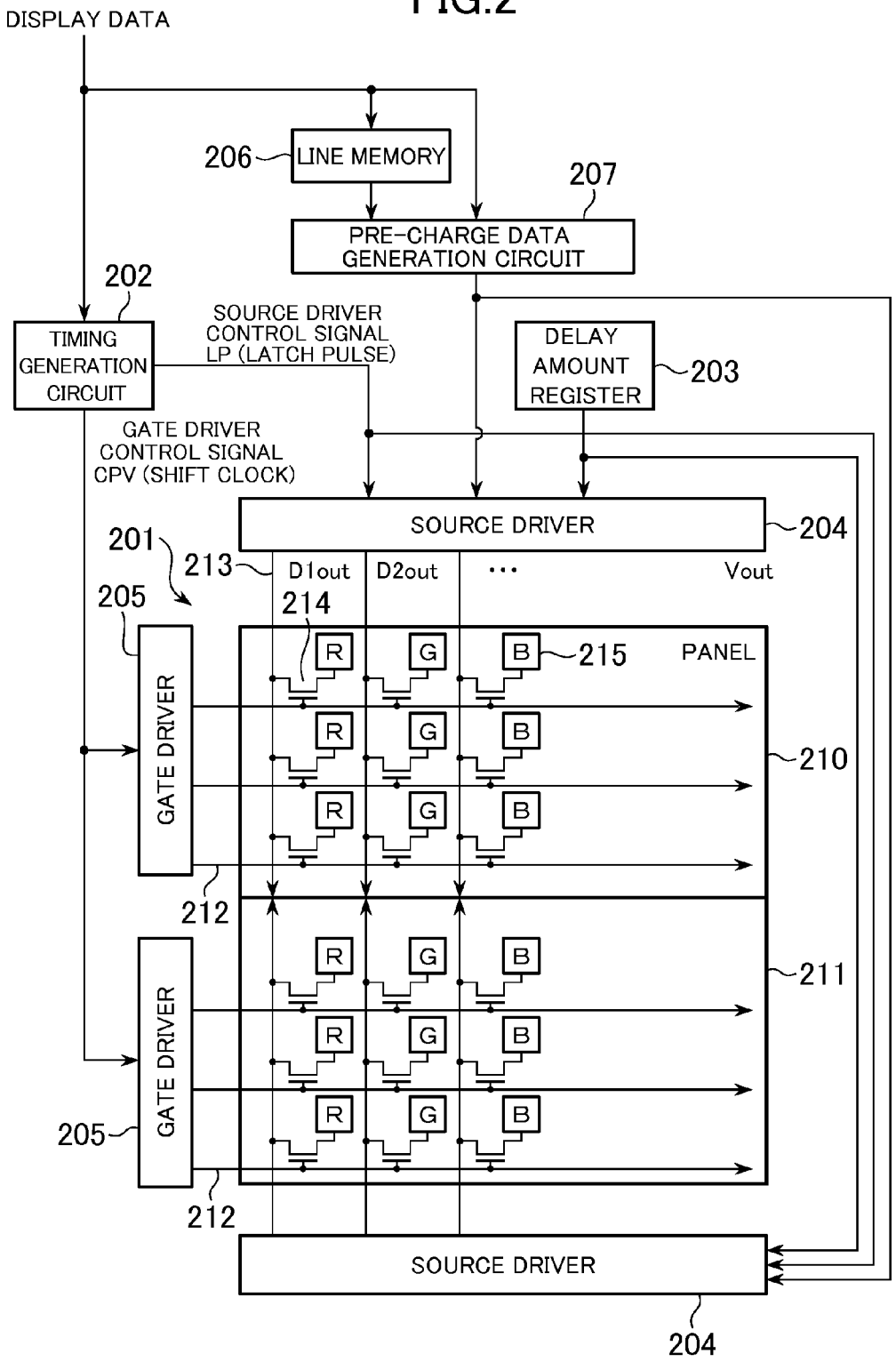
FIG. 2 is a conceptual diagram of a pixel circuit formed on the TFT substrate illustrated in FIG. 1.

FIG. 2 is a conceptual diagram of a pixel circuit formed on the TFT substrate illustrated in FIG. 1. As illustrated in FIG. 2, the display device 100 includes, for example, a display region 201, a timing generation circuit 202, a delay amount register 203, two source drivers 204, two gate drivers 205, a line memory 206, and a pre-charge data generation circuit 207.

FIG. 2 illustrates a case in which two gate drivers 205 and two source drivers 204 are used. However, a different number of gate drivers 205 and source drivers 204 may be included. For example, four gate drivers may be provided, two on the left side and two on the right side of the display region 201, and four source drivers may be provided, two above and two below the display region 201, corresponding to the gate drivers.

The display region 201 includes, for example, a first display region 210 corresponding to an upper half of the display region 201 illustrated in FIG. 2, and a second display region 211 corresponding to a lower half of the display region 201. Further, in the first display region 210 and the second display region 211, a plurality of gate signal lines 212 arranged at roughly equal intervals in the horizontal direction of FIG. 2 and a plurality of video signal lines 213 arranged at roughly equal intervals in the vertical direction of FIG. 2 are arranged.

The plurality of gate signal lines 212 arranged in the first display region 210 are connected to a first gate driver 205, and the plurality of gate signal lines 212 arranged in the second display region 211 are connected to a second gate driver 205. Further, the plurality of video signal lines 213 arranged in the first display region 210 are connected to a first source driver 204, and the plurality of video signal lines 213 arranged in the second display region 211 are connected to a second source driver 204.

Namely, as illustrated in FIG. 2, the first and second gate drivers 205 are aligned in the vertical direction of FIG. 2. The first source driver 204 is arranged on an upper side of the display region 201 of FIG. 2, and the second source driver 204 is arranged on a lower side of the display region 201 of FIG. 2.

The first and second gate drivers 205 include a plurality of basic circuits (not shown) that respectively correspond to the plurality of gate signal lines 212. Each basic circuit includes a plurality of TFTs and capacitors. Based on a gate driver control signal (CPV) from the timing generation circuit 202, within one frame period, a gate signal indicating a high voltage for a corresponding gate scanning period (signal high period) and a low voltage for other periods (signal low period) is output to the corresponding gate signal line 212.

Each of the pixels, which have been subdivided into a matrix shape by the gate signal lines 212 and the video signal lines 213, includes a TFT 214, a pixel electrode 215, and a common electrode (not shown). The gate of the TFT 214 is connected to the gate signal line 212. One of the source and the drain is connected to the video signal line 213, and the other is connected to the pixel electrode 215. Further, the common electrode is connected to a common signal line (not shown). The pixel electrode 215 and the common electrode are arranged so as to oppose each other. In addition, the pixel electrode 215 corresponds to each color of red (R), green (G), or blue (B).

Next, an outline of operation of the thus-configured pixel circuit is described. The gate driver 205 outputs a gate signal to the gate of the TFT 214 via the gate signal line 212. Based on a source driver control signal (LP) from the timing generation circuit 202, the source driver 204 supplies via the video signal line 213 a video signal voltage to the TFT 214 to which the gate signal has been output. The video signal voltage is applied to the pixel electrode 215 via the TFT 214. At this stage, a potential difference is produced between the pixel electrode 215 and the common electrode.

The alignment of the liquid crystal molecules of the liquid crystal material inserted between the pixel electrode 215 and the common electrode is controlled by the source driver 204 controlling this potential difference. In the liquid crystal material, light from the backlight unit 103 is guided. Therefore, by controlling the alignment and the like of the liquid crystal molecules in the above manner, the amount of light from the backlight unit 103 can be adjusted, and as a result, an image can be displayed. Note that, in this embodiment, the display region 201 is divided into the first display region 210 and the second display region 211. Hence, the first gate driver 205 and the first source driver 204 control the pixels of the first display region 210, and the second gate driver 205 and the second source driver 204 control the pixels of the second display region 211.

Next, operation of the pixel circuit is described more specifically. The line memory 206 stores, for each line, the display data input from a driver (not shown), and outputs the stored display data to the pre-charge data generation circuit 207. The pre-charge data generation circuit 207 generates pre-charge data based on the current display data and the display data of the line one line before that was stored in the line memory 206.

Figure 3:
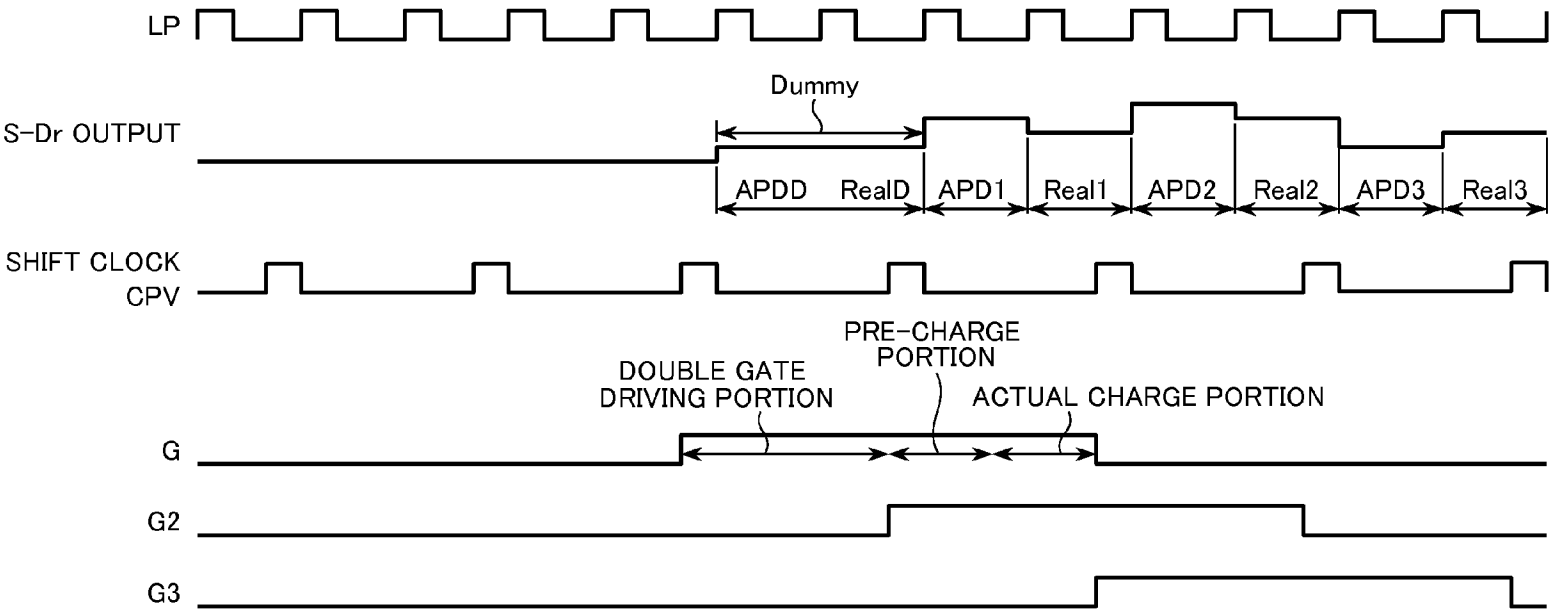
FIG. 3 is a diagram illustrating pre-charge data.

Specifically, as illustrated in FIG. 3, for example, the pre-charge data generation circuit 207 generates pre-charge data APD1, APD2 and the like to be added before input of an actual data signal Real1, Real2 and the like that are based on the display data. Note that, FIG. 3 illustrates a case in which so-called double gate driving, in which the ON period of the gate signal overlaps at adjacent gate signal lines 212 (e.g., G2 and G3), is performed. In other words, the gate signal is, for example, turned on for two horizontal periods, with the output signal to the pixel of the immediately previous line being output to the pixel during the initial horizontal period, and the corresponding pre-charge data (pre-charge portion) and the corresponding data signal being output from the source driver 204 during the latter horizontal period (S-Dr output). Note that, for the initial actual data signal Real1, there is no output signal to the immediately previous line. Hence, dummy data (APDD, RealD) is used. Details of the above-mentioned double gate driving and pre-charge technology are well known, and hence a description of these points is omitted here.

The timing generation circuit 202 controls the first and second gate drivers 205 and the first and second source drivers 204. Specifically, the timing generation circuit 202 controls the first and second gate drivers 205 by outputting a gate driver control signal (CPV) to each of the first and second gate drivers 205. Further, the timing generation circuit 202 controls the first and second source drivers 204 by outputting a source driver control signal (LP) to each of the first and second source drivers 204. The delay amount register 203 stores a delay amount of the output signal to be output from the source drivers 204. For example, when the video signal lines 213 are divided into groups consisting of a predetermined number of video signal lines 213 in order from the gate driver 205, the delay amount register 203 stores a delay amount for each group.

Figure 4:
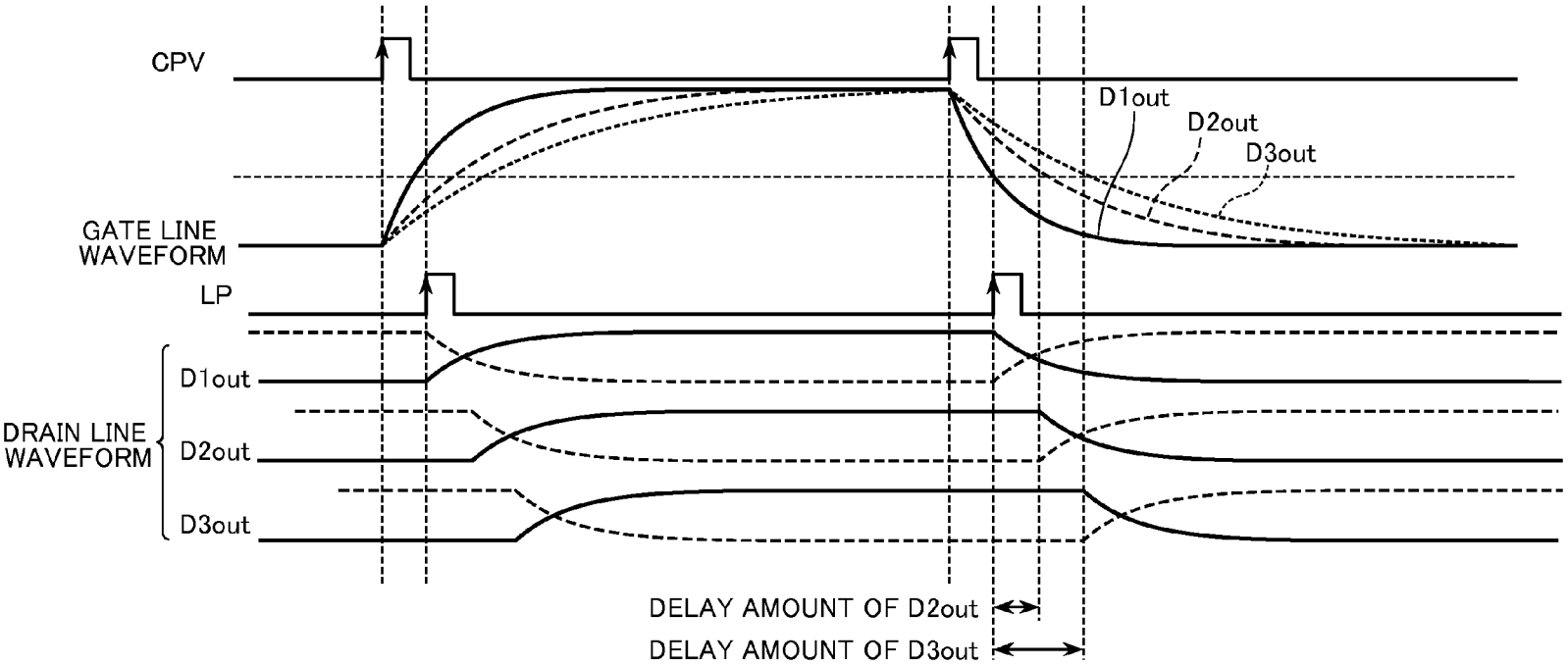
FIG. 4 is a diagram illustrating a delay amount.

Specifically, as illustrated in FIG. 4, the delay amount register 203 stores each delay amount from the rise of the LP, and the source driver 204 outputs an output signal (drain line waveform) corresponding to each corresponding video signal line 213 ($D_{1OUT}$, $D_{2OUT}$, $D_{3OUT}$) based on each delay amount stored in the delay amount register 203.

Here, the gate driver 205 outputs the gate signal based on the timing of the rise of the shift clock (CPV). However, as illustrated in FIG. 4, the waveform of the gate signal is less sharp further away from the gate driver 205. Namely, as illustrated in FIG. 4, for example, the gate signal corresponding to $D_{2OUT}$ has a flatter waveform than the gate signal corresponding to $D_{1OUT}$, and the gate signal corresponding to $D_{3OUT}$ has a flatter waveform than the gate signal corresponding to $D_{2OUT}$. Therefore, the respective delay amounts are set so that sufficient luminance can be emitted even for pixels that are separated from the gate driver 205.

As described above, when gate scanning is performed in the direction from the edge of the display region 201 toward the center, the timing of the output of the gate signal may be out of step with the timing of the output of the corresponding video signal. In such a case, for example, when the 500-th line is scanned, the video signal and the like corresponding to the 501-st line may be output. However, the period after the final line (e.g., the 1,080-th line) of the divided first display region 210 is scanned is a flyback period during which the video signal is not output. Therefore, especially for a so-called solid display (e.g., a uniform white display), the luminance of the final line positioned in the center of the screen is less than the luminance of the other lines.

Accordingly, in this embodiment, the delay amount is set so that the video signal corresponding to the final line, including a portion of a vertical flyback period after one frame period has finished, is output by adjusting the delay amount for the output of the video signal corresponding to the final line. In other words, in the delay amount register 203, the delay amount is set to be larger than the delay amount to be set when driving is performed without dividing the display region 201 or the delay amount to be set when driving the divided display region 201 from the center toward the edge described below.

Figure 5A:
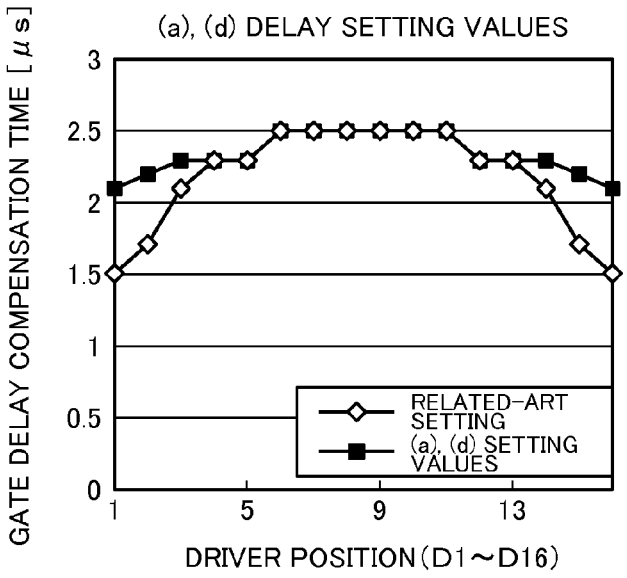
FIG. 5A shows an example of a delay amount setting value.

Specifically, an example of when the delay amount is thus set to be larger is described below with reference to FIG. 5A and FIG. 6. FIGS. 5A to 5D show examples of a delay amount setting value and an APD setting value for a case in which, as illustrated in FIG. 6, four source drivers 204 are provided, two above the display region 201 and two below the display region 201, and four gate drivers 205 are provided, two on the left side and two on the right side of the display region 201. In other words, in this case, the display region 201 is driven by horizontally and vertically dividing the display region 201 into the four sections illustrated in FIG. 6. In FIG. 6, the gate drivers 205 are not illustrated. Further, D1 to D16 in FIG. 6 represent the respective blocks when the plurality of video signal lines 213 are divided into 16 blocks. Control of the output from each source driver 204 is performed at each block. In addition, in FIG. 6, the gate direction scan directions are indicated by (a) to (d).

As shown in FIG. 5A, the gate delay compensation time (equivalent to the delay amount) of the blocks near the corresponding gate driver 205 (e.g., D1 to D3, and D14 to D16) is set to be larger than the gate delay compensation time for a case in which driving is performed without dividing the display region 201 (related-art setting in FIG. 5A). Consequently, when scanning the gate signal lines 212 in order from the edge of the divided display region 201 toward the center, a decrease in the luminance of the final line can be prevented, and the image quality of the screen center portion can be improved.

Figure 5B:
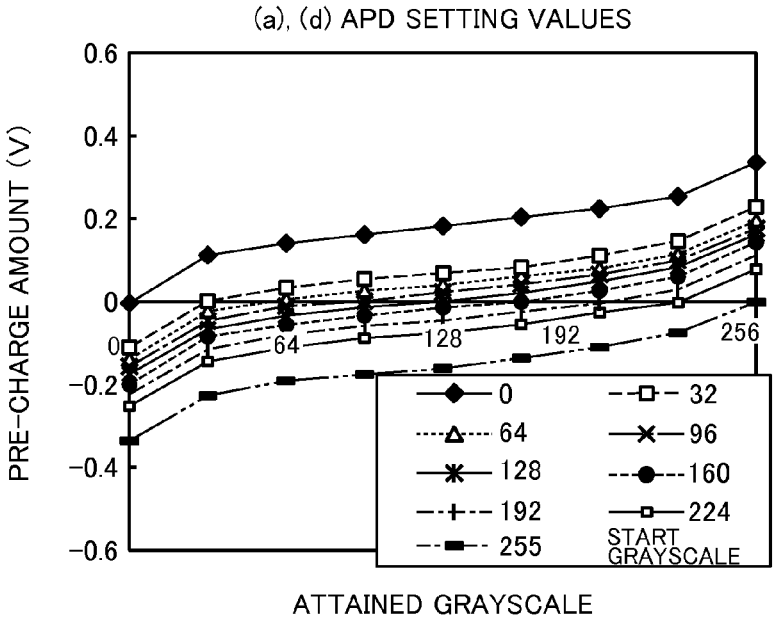
FIG. 5B shows an example of an APD setting value.

Note that, in this case, as shown in FIG. 5B, the setting value of an adaptive pre-charge drive (APD) value (pre-charge data) is the same as for the case in which driving is performed without dividing the display region 201. This is because when gate scanning is performed from the edge of the divided display region 201 toward the center, the first line is positioned at the edge of the screen, and hence, as described below, the first line does not stand out much even if the luminance of the first line is different from the luminance of the other lines. However, as described below, even when gate scanning is performed from the edge of the screen toward the center, obviously the APD setting value (e.g., the APD setting value of FIG. 5D) for the case described below, in which gate scanning is performed from the center of the screen toward the edge, may also be used.

Next, a case is described in which gate scanning of the divided display region 201 is performed from the center toward the edge (e.g., the case of scan directions (b) and (c) of FIG. 6). Here, for example, pre-charge data that is based on the data signal of the immediately previous line may be used, as described with reference to FIG. 3. However, in this example, the first line does not have an immediately previous line. Therefore, dummy data is used for the immediately previous line. Further, when driving is performed without dividing the display region 201, or when gate scanning is performed from the edge of the screen toward the center of the screen as described above, an APD setting value optimized for the center of the screen is used.

However, when the display region 201 is divided and gate scanning is performed from the center of the screen toward the edge, if the optimum APD setting value is used for the center of the screen, because the first line is positioned in the center of the screen, there is a noticeable decrease in the luminance due to the effects of pre-charge on the first line. Therefore, in this embodiment, the pre-charge amount is set to be optimum for the first line.

Figure 5C:
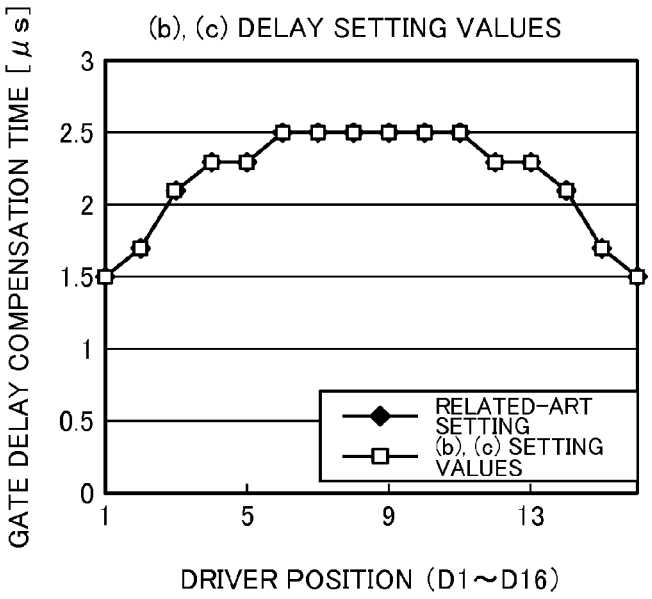
FIG. 5C shows an example of a delay amount setting value.
Figure 5D:
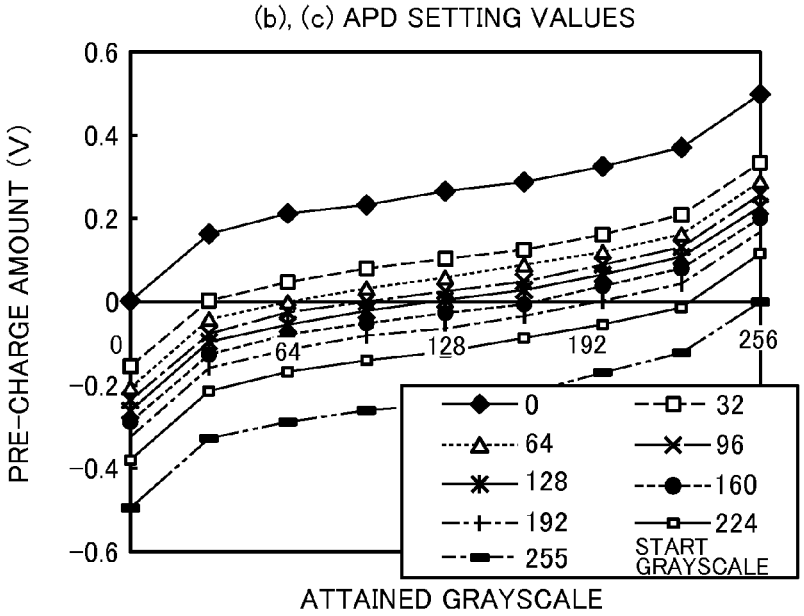
FIG. 5D shows an example of an APD setting value.
Figure 6:
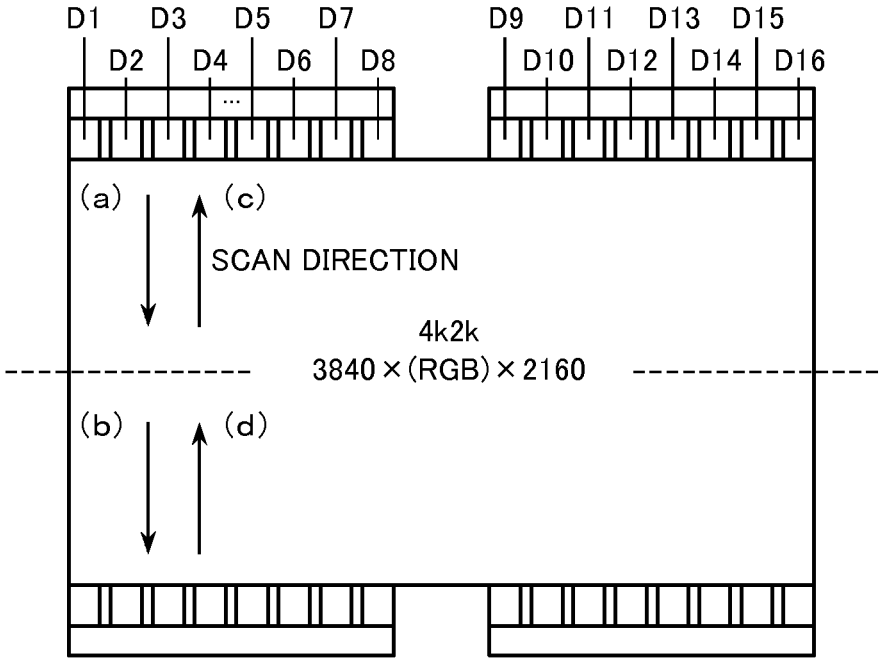
FIG. 6 illustrates the divisional drive system shown in FIGS. 5A to 5D.

This point is specifically described here using the cases shown in FIGS. 5A to 5D. As shown in FIG. 5D, the pre-charge amount (pre-charge data) is set to be larger than the case shown in FIG. 5B, in which driving is performed without dividing the display region 201, or scanning is performed from the edge of the screen toward the center of the screen.

Consequently, for example, the difference in luminance between the first line and the other lines can be reduced compared with when using an APD setting value optimized for the center of the screen when driving is performed without dividing the display region 201 and the like. As a result, image quality at the center of the screen is improved.

Note that, when the display region 201 is divided and gate scanning is performed from the center of the screen toward the edge, similar to the case in which driving is performed without dividing the display region 201 (when gate scanning of one display region 201 is performed in order from the top to the bottom), because the final line is positioned at the edge of the screen, the final line does not stand out even if the luminance of the final line is less than the luminance of the other lines. Therefore, as shown in FIG. 5C, the delay setting value is the same setting value as when driving is performed without dividing the display region 201. However, as described above, even when gate scanning is performed from the center of the screen toward the edge, obviously the delay setting value (e.g., the setting value of FIG. 5A) for the above case, in which gate scanning is performed from the edge of the screen toward the center, may also be used.

The present invention is not limited to the above-mentioned embodiment, and may be modified in various ways. For example, the structures described in the embodiment may be replaced with structures that are essentially the same, structures that provide essentially the same operation and effect, or structures capable of achieving the same purpose.

Specifically, for example, in the above, although a case in which gate scanning is performed for each of the first display region 210 and the second display region 211 from the center of the screen toward the edge, and a case in which gate scanning is performed for each of the first display region 210 and the second display region 211 from the edge of the screen toward the center, are mainly described, the present invention is not limited to this. Namely, for example, gate scanning may be performed for the first display region 210 from the center toward the edge, and for the second display region 211, gate scanning may be performed from the edge of the screen toward the center. In other words, a combination of any of the four gate scan directions illustrated in FIG. 6 may be used. Further, in the above-mentioned embodiment, for example, an order changing unit may be provided in the pixel circuit to enable the gate scan direction of each gate driver 205 to be changed to any one of an upward or a downward direction of the panel. In this case, the gate scan direction may also be changed based on the content of the display data. In addition, the number and the like of the gate drivers 205 and the source drivers 204 are an example. A different number of gate drivers 205 and source drivers 204 may be used.

Further, although the liquid crystal display device has been assumed and described above, the display device may be a display device using various types of light-emitting elements such as organic EL elements, inorganic EL elements, and field-emission devices (FEDs). Further, the display device described above may be used as various types of display devices for information display such as a display for personal computer, a display for TV broadcast reception, or a display for advertisement display. Moreover, the display device may also be used as a display unit of various electronic devices such as a digital still camera, a video camera, a car navigation system, a car audio system, a game machine, and a personal digital assistance.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising, a first display region and a second display region arranged in one direction, each of which comprises a plurality of pixels that are subdivided into a matrix by a plurality of gate lines and a plurality of data lines;

a first gate driver configured to scan in order the plurality of gate lines included in the first display region, and a second gate driver configured to scan in order the plurality of gate lines included in the second display region;

a first source driver configured to output, for the plurality of data lines in the first display region, video signals that show a grayscale signal based on a predetermined delay amount, and a second source driver configured to output, for the plurality of data lines in the second display region, video signals that show a grayscale signal based on a predetermined delay amount;

each predetermined delay amount including a delay time of a corresponding data line from a rising of the source driver control signal (LP) until outputting a data signal;

a timing generation circuit to control the first and second gate drivers and the first and second source drivers by outputting a source driver control signal (LP) to each of the first and second source drivers; and a register configured to store each of the predetermined delay amounts, wherein the register stores each of the predetermined delay amounts such that when the first gate driver scans in a first direction from a position distant from the second display region toward the second display region, the video signal output to pixels disposed closest to the second display region is output to pixels in a period including a part of a vertical flyback period after the scan in the first direction is finished.

2. The display device according to claim 1, further comprising a pre-charge data generation unit configured to generate pre-charge data to be output to each of the plurality of pixels before an output signal corresponding to the grayscale signal is output to the plurality of corresponding data lines, wherein each of the plurality of source drivers outputs to the plurality of data lines the video signal that is based on the pre-charge data and the grayscale signal.

3. The display device according to claim 2, wherein the pre-charge data to be set when the at least one gate driver scans in a first order is larger than the pre-charge data to be set when the at least one gate driver scans in a second order from a center of a display region toward an edge of the display region.

4. The display device according to claim 3, further comprising an order changing unit configured to change a scanning order from the first order to the second order or from the second order to the first order for each of the first and second display regions.

5. A display device, comprising, a first display region and a second display region arranged in one direction, each of which comprises a plurality of pixels that are subdivided into a matrix shape by a plurality of gate lines and a plurality of data lines;

a first gate driver configured to scan in order the plurality of gate lines in the first display region, and a second gate driver configured to scan in order the plurality of gate lines in the second display region;

a first source driver configured to output, for the plurality of data lines in the first display region, video signals showing a grayscale signal, and a second source driver configured to output, for the plurality of data lines in the second display region, video signals that show a grayscale signal; and a pre-charge data generation unit configured to generate pre-charge data to be output to each of the plurality of pixels before the gray scale signal is output to a plurality of corresponding data lines, wherein each of the first and second source drivers outputs to the plurality of data lines the video signal that is based on the pre-charge data, and wherein the pre-charge data to be set when the first gate driver scans in a first order from a first position distant from the second display region toward the second display region is larger than the pre-charge data to be set when the first gate driver scans in a second order from a second position from the second display region toward the first position.

* * * * *